United States Patent [19]

Jones et al.

[11] 4,333,505

[45] Jun. 8, 1982

[54] CLAMP FOR PREVENTING THE UNINTENTIONAL SEPARATION OF A CONDUIT FROM A CONTAINER

[75] Inventors: William L. Jones, Victor, N.Y.; Jon A. Christensen, Lake Zurich, Ill.

[73] Assignee: Baxter Travenol Laboratories, Inc., Deerfield, Ill.

[21] Appl. No.: 166,212

[22] Filed: Jul. 7, 1980

[51] Int. Cl.[3] ..... B65B 3/00

[52] U.S. Cl. ..... 141/383; 128/214 R; 128/272; 24/11 R

[58] Field of Search ..... 285/405, 420, 114; 211/74; 141/382–386, 392, 311 R; 128/214 R, 272; 24/11 R, 260, 339, 346

[56] References Cited

U.S. PATENT DOCUMENTS

| | | | |
|---|---|---|---|
| 979,170 | 12/1910 | Koharu | 24/339 |
| 2,121,123 | 6/1938 | Erikson et al. | 128/214 R |
| 2,410,546 | 11/1946 | McCabe | 128/214 R |
| 3,479,069 | 11/1969 | Sedam | 285/420 |
| 4,123,091 | 10/1978 | Cosentino et al. | 128/214 R |

*Primary Examiner*—John W. Shepperd

*Attorney, Agent, or Firm*—John D. Kirby, Jr.; Gary W. McFarron; Bradford R. L. Price

[57] ABSTRACT

In an intravenous fluid administration assembly, there is provided a suspended, fluid holding container having a stopper closing off its mouth, a conduit having a hollow spike inserted into the stopper for gravity flow delivery of fluid from the container to the conduit, and a clamp for preventing the unintentional separation of the spike from the stopper. The clamp has a first portion having an opening through which the container's neck extends downwardly and a second portion having an opening through which the spike extends upwardly. The first portion seats on an abutment on the container's neck and the second portion seats under a flange extending outwardly from the spike. First ends of the first and second portions are connected by a third portion of the clamp and the openings in the first and second portions extend to those portions' other free ends. The clamp is slid over the container and spike, after insertion of the spike into the stopper, by placement of the free end and opening of the first portion around the container's neck and over the abutment and free end and opening of the second portion around the conduit and below the flange extending outwardly therefrom.

1 Claim, 3 Drawing Figures

CLAMP FOR PREVENTING THE UNINTENTIONAL SEPARATION OF A CONDUIT FROM A CONTAINER

BACKGROUND OF THE INVENTION

This invention relates to a clamp for preventing the unintentional separation of a fluid delivery conduit from a suspended, fluid holding container, with which the conduit is in a gravity flow relationship.

In certain intravenous administration assemblies, a fluid holding container, which is generally made of glass, is suspended in an inverted position with its mouth down. A stopper, such as one made of rubber, closes off the mouth of the container. A rigid conduit having a spike at its free end and tubing connected to its other end is provided. The spike is inserted into the stopper to deliver fluid from the container and through the tubing for further administration to a patient.

It has been found that because of patient movement or nursing personnel manipulation of the patient or assembly, the spike may be unintentionally separated from the stopper. The clamp of the present invention prevents such a separation.

This clamp is easily fit over the container's neck and the spike and does not interfere with the operation of the assembly. It does not hamper or add significantly to the time necessary for setting up the assembly because it is easily slipped onto the container and spike after insertion of the spike into the stopper. As will be apparent from the discussion below, the clamp can be reused and is easily removable from the assembly after fluid delivery is completed.

Thus, an object of the present invention is to provide a clamp sufficiently rigid to hold the spike in the stopper of the container against forces tending to separate it therefrom and to provide a clamp which is easily operable.

These and other objects and advantages of the clamp of the present invention will be apparent to those skilled in the art from a reading of the detailed description of this invention provided below, in conjunction with a study of the drawings appended hereto.

SUMMARY OF THE INVENTION

In accordance with this invention, a clamp is provided for preventing the unintentional separation of a conduit from a suspended, fluid holding container, when the conduit is in the gravity flow relationship with the container. The clamp includes first, second, and third portions, the third portion connected to an end of each of the first and second portions. Openings are provided in the first and second portions, at least a part of each opening extending to the other, free end of the portion. The largest dimension of the opening in the first portion is smaller than the diameter of an abutment on the container and the largest dimension of the opening in the second portion is smaller than the diameter of a flange extending outwardly from the conduit. After insertion of the conduit into the mouth of the container, the clamp is slid onto the container and conduit, so that the first portion overlies the abutment on the container and the second portion underlies the flange on the conduit. Because the abutment and the flange are larger than the respective openings of the first and second portions, the conduit cannot be withdrawn from the mouth of the container or separated therefrom without an intentional, reverse operation of the clamp.

DETAILED DESCRIPTION OF THE INVENTION

Figure 1:
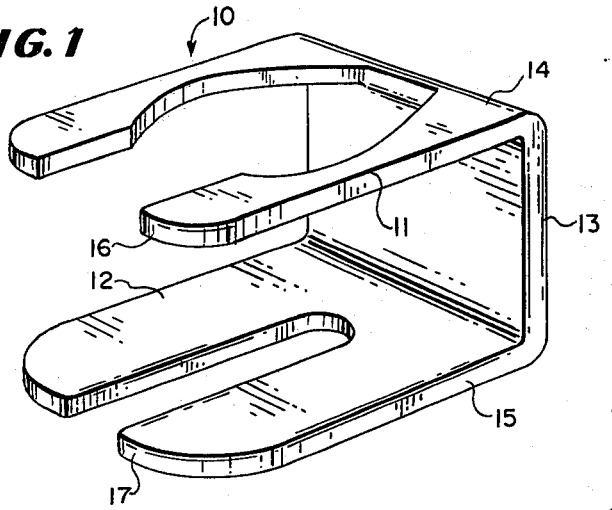
FIG. 1 is a perspective view of the clamp of the present invention.

Referring to FIG. 1, there is shown a clamp 10 having a first portion 11, a second portion 12, and a third portion 13 connecting and intregal with an end 14 of first portion 11 and an end 15 of second portion 12.

Figure 3:
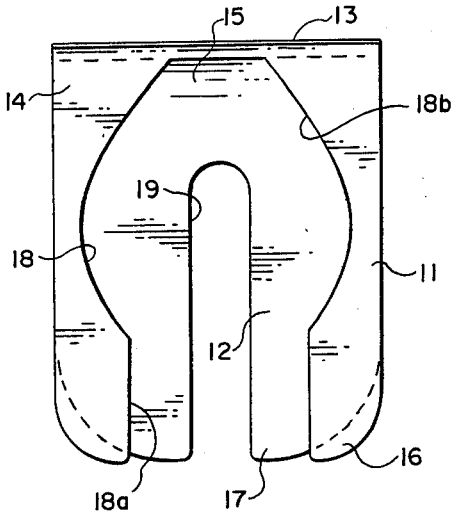
FIG. 3 is a top plan view of the clamp of FIG. 1.

First portion 11 also has a free end 16 and second portion 12 has a free end 17. As shown best in FIG. 3, openings are provided in portions 11 and 12. Opening 18 in first portion 11 has two parts, 18*a* and 18*b*. Opening part 18*a* is generally circular and leads to the essentially, straight-sided opening 18*b* terminating at the extremity of free end 16 of first portion 11. Opening 19 in second portion 12 is constant in dimension and resembles a rounded-off rectangle.

Figure 2:
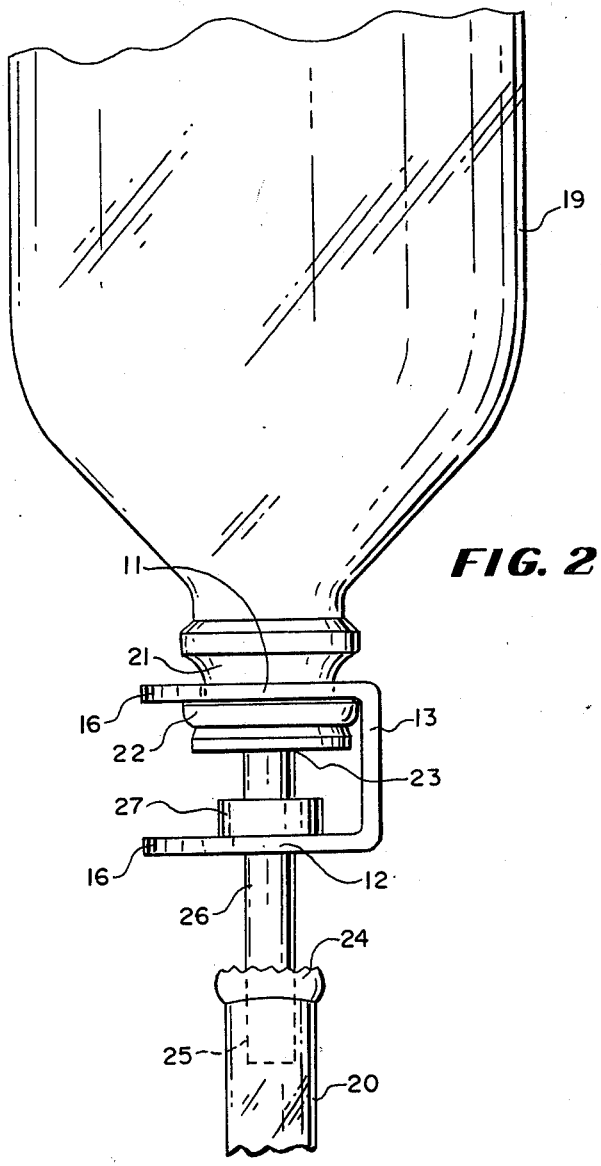
FIG. 2 is a perspective view of a container, a conduit inserted into the mouth of the container, and the clamp of FIG. 1 applied thereto.

Referring to FIG. 2, a container 19 and a conduit 20 are shown. The container has a neck portion 21 and an abutment 22 on that neck portion adjacent its mouth 23. Conduit 20 has an end 24 into which a first end 25 of a spike 26 is inserted. Generally, this spike will be heat sealed or otherwise affixed within the bore of conduit 20. Although not shown in FIG. 2, generally a pointed tip portion of the spike will be inserted in a stopper affixed in mouth 23 of container 19 for delivery of fluid from the container, through the spike, and into conduit 20. Extending outwardly from spike 26 is a flange 27.

To deliver fluid from container 19, through spike 26, through conduit 20, and into a patient, container 19 is inverted and suspended from a suitable hanging apparatus. Spike 26 is inserted into the stopper in mouth 23 of the container and applicable flow controlling means on tubing 20 are opened to allow gravity flow of the fluid therethrough. To insure that during the fluid delivery procedure spike 26 is not separated or disengaged from container 19, clamp 10 holds spike 26 in the stopper secured in the container's mouth. As shown in FIG. 2, first portion 11 of the clamp overlies abutment 22 on the neck of the container and second portion 12 thereof underlies flange 27 on spike 26. To apply the clamp to the container and spike, portions 11 and 12 are slid over the neck of the container above abutment 22 and over spike 26 under flange 27, respectively, which prevents any unintentional downward or vertical separation of the spike from the container.

Referring again to FIG. 3, it is apparent that opening 19 in second portion 12 is of a constant dimension, whereas opening 18 in first portion 11 has two opening parts 18*a* and 18*b*, which have different dimensions. The reason for this is to prevent any unintentional horizontal, sliding of the clamp off the container and spike. Part 18*b* of opening 18 is dimensioned to accomodate the neck of the container and overlie abutment 22, but opening part 18*a* is much smaller than the neck of the container. At least first portion 11 of the clamp can be made from a flexible material, so that the opening defining sections of free end 16 can be spread apart and opening part 18*a* can be enlarged so that the clamp can be applied to the container. After the clamp has been applied and the container's neck is positioned within part 18*b*, part 18*a* will reassume its original dimension because the flexible, sections of free end 16 will spring back to their original positions. Thus, there will be some resistance to the container's neck inadvertedly moving outwardly from opening 18*b* through opening 18*a*, which will prevent any accidental disengagement of the clamp from the container and spike. It is within the scope of this invention that the openings in first portion 11 and second portion 12 can each have the same dimensions, such as is shown for first portion 11 or second portion 12 in FIG. 3, i.e., either of the portions can have a constant or varying dimensional opening or both portions can have the same opening dimensions.

Other embodiments of this invention will be apparent to one skilled in the art and the scope of this invention is to be determined by the claims appended hereto.

What is claimed is:

1. In a fluid assembly including a container suspended in an inverted position, said container having a relatively narrow neck defining a discharge opening from said container, said neck having an enlarged diameter portion adjacent the end thereof, a stopper disposed in said discharge opening and a fluid delivery conduit terminating in a spike, said spike being inserted sufficiently into said stopper to communicate with the interior of said container, said spike having an enlarged flange portion exterior of said container, the improvement comprising:

a generally U-shaped clamp for preventing the unintended separation of the spike from the stopper, said clamp having a pair of flat, substantially parallel leg portions, each leg portion terminating in a free end;

a spike-receiving slot defined in one of said leg portions and extending through the free end thereof, said spike-receiving slot having a width less than the width of said flange to prevent said flange from passing therethrough;

the other of said leg portions defining a neck-receiving aperture therein and a slot communicating between said aperture and the free end of said other leg portion, said neck-receiving aperture being smaller than said enlarged diameter portion of the container neck to prevent withdrawal of the neck through said aperture, said communicating slot having a width smaller than the width of said container neck and said other leg portion being sufficiently resilient to permit temporary spreading of said communicating slot to receive said container neck being disposed in neck-receiving aperture of said other leg portion, whereby said enlarged diameter neck portion and said spike flange are captured between said leg portions of said clamp, said clamp thereby preventing unintended separation of said spike from said stopper.

* * * * *